US006779283B2

(12) United States Patent
Gabrielli

(10) Patent No.: US 6,779,283 B2
(45) Date of Patent: Aug. 24, 2004

(54) ARTICULATED REINFORCEMENT STRUCTURE AND FOOTWEAR PROVIDED WITH SUCH A STRUCTURE

(75) Inventor: Andrea Gabrielli, Predazzo (IT)

(73) Assignee: Tenica SpA, Treviso (IT)

( * ) Notice: Subject to any disclaimer, the term of this patent is extended or adjusted under 35 U.S.C. 154(b) by 0 days.

(21) Appl. No.: 10/312,210

(22) PCT Filed: Apr. 16, 2002

(86) PCT No.: PCT/EP02/04199

§ 371 (c)(1),
(2), (4) Date: Dec. 23, 2002

(87) PCT Pub. No.: WO02/085148

PCT Pub. Date: Oct. 31, 2002

(65) Prior Publication Data

US 2003/0097769 A1 May 29, 2003

(30) Foreign Application Priority Data

Apr. 23, 2001 (IT) ..... TV2001A0050

(51) Int. Cl.[7] ..... A43B 5/04; A43B 7/20
(52) U.S. Cl. ..... 36/89; 36/115
(58) Field of Search ..... 36/89, 118.2, 115, 36/118.4, 118.8

(56) References Cited

U.S. PATENT DOCUMENTS 4,602,443 A * 7/1986 Spademan ..... 36/118.4
5,437,466 A 8/1995 Meibock et al.
5,678,330 A 10/1997 Van Dyke et al.
5,778,563 A 7/1998 Ahlbaumer
6,098,317 A 8/2000 Lazzaroni
6,168,172 B1 * 1/2001 Meibock et al. ..... 36/115
6,233,848 B1 * 5/2001 Bonaventure ..... 36/89

FOREIGN PATENT DOCUMENTS

EP 0 634 115 A 1/1995
FR 2 726 976 A 5/1996

* cited by examiner

*Primary Examiner*—Ted Kavanaugh
(74) *Attorney, Agent, or Firm*—Birch, Stewart, Kolasch & Birch, LLP

(57) ABSTRACT

Articulated structure for the reinforcement of footwear articles, comprising a first rigid part (110), which comprises a sole (111) and an uprising portion (112) for the heel of the user, and a second and a third part (120, 130), arranged on opposite sides of said first part (110) with respect to the longitudinal center-line plane. Each one of these parts is separately joined to said uprising portion (112) of the first part (110) so as to obtain independent forward movements (FA, FB) and rearward movements (FC, FD) of a limited extent thereof. USE: Sports footwear, work-shoes and the like. ADVANTAGES: improved movement freedom of the foot, while maintaining the desired side support function unaltered; improved manufacturability of the footwear.

11 Claims, 3 Drawing Sheets

100
110
111
112
113
115
116
117
118
119
120
121
122
123
124
125
141
143

ARTICULATED REINFORCEMENT STRUCTURE AND FOOTWEAR PROVIDED WITH SUCH A STRUCTURE

This application is the national phase under 35 U.S.C. § 371 of PCT International Application No. PCT/EP02/04199 which has an International filing date of Apr. 16, 2002, which designated the United States of America.

DESCRIPTION

1. Field of the Invention

The present invention refers to an articulated reinforcement structure and the footwear articles, not only for sports applications such as ski boots and mountaineering boots, or the boots used in connection with skates with in-line rollers, cross-country-skiing, etc., but also work-footwear and the like, that are provided with such a structure.

2. Description of the Related Art

A typical reinforcement structure for sports and similar footwear of the above cited kind—see patent publication U.S. Pat. No. 5,437,466—consists of a number of parts that are made as separately moulded pieces of polymeric materials having particularly strong mechanical properties. One of these parts is constituted by the sole, which in this particular case is fastened on to a support framework for a plurality of in-line rollers, a toe portion and an uprising rear portion that accommodates the heel by wrapping it up, whereas a second part is a leg-piece that is intended for supporting the ankle and is joined to said uprising rear portion of said first part by means of a pair of pins enabling it to pivotally move about an axis perpendicular to the longitudinal centre-line plane of the foot. In this way, the user is capable of bending his/her legs forwards and backwards, whereas the inherent rigidity of the parts ensure an effective side support to the foot minimizing the risk of sprains, when the leg-piece is duly tightened by means of appropriate fastening devices.

The major drawback of an articulated structure of this kind lies in the fact that the foot is prevented from performing any other movement than the above cited pivoting movement, unlike what many users would on the contrary desire or appreciate. The construction-related complexity of the leg-piece, which is adapted to envelop the lower portion of the leg of the user all around it, i.e. on 360 degrees, and to a not negligible height thereof, is furthermore such as to require the use of sophisticated moulding tools and a relatively large amount of some premium-grade polymeric material that may be quite expensive.

It would therefore be desirable, and is actually a main object of the present invention, to provide an articulated reinforcement structure for footwear articles of the above mentioned kind that does away with the above cited drawbacks and that, in particular, ensures the user with a great freedom of movement of both the foot and the leg, without anyway impairing the inherent protection and support functions thereof to any extent whatsoever.

An articulated footwear reinforcement structure having the features as recited in the appended claims enables this and further objects to be reached, as this may be readily understood from the description given below by way of example of a preferred, although not sole embodiment of the present invention with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figures 1, 3, 4:
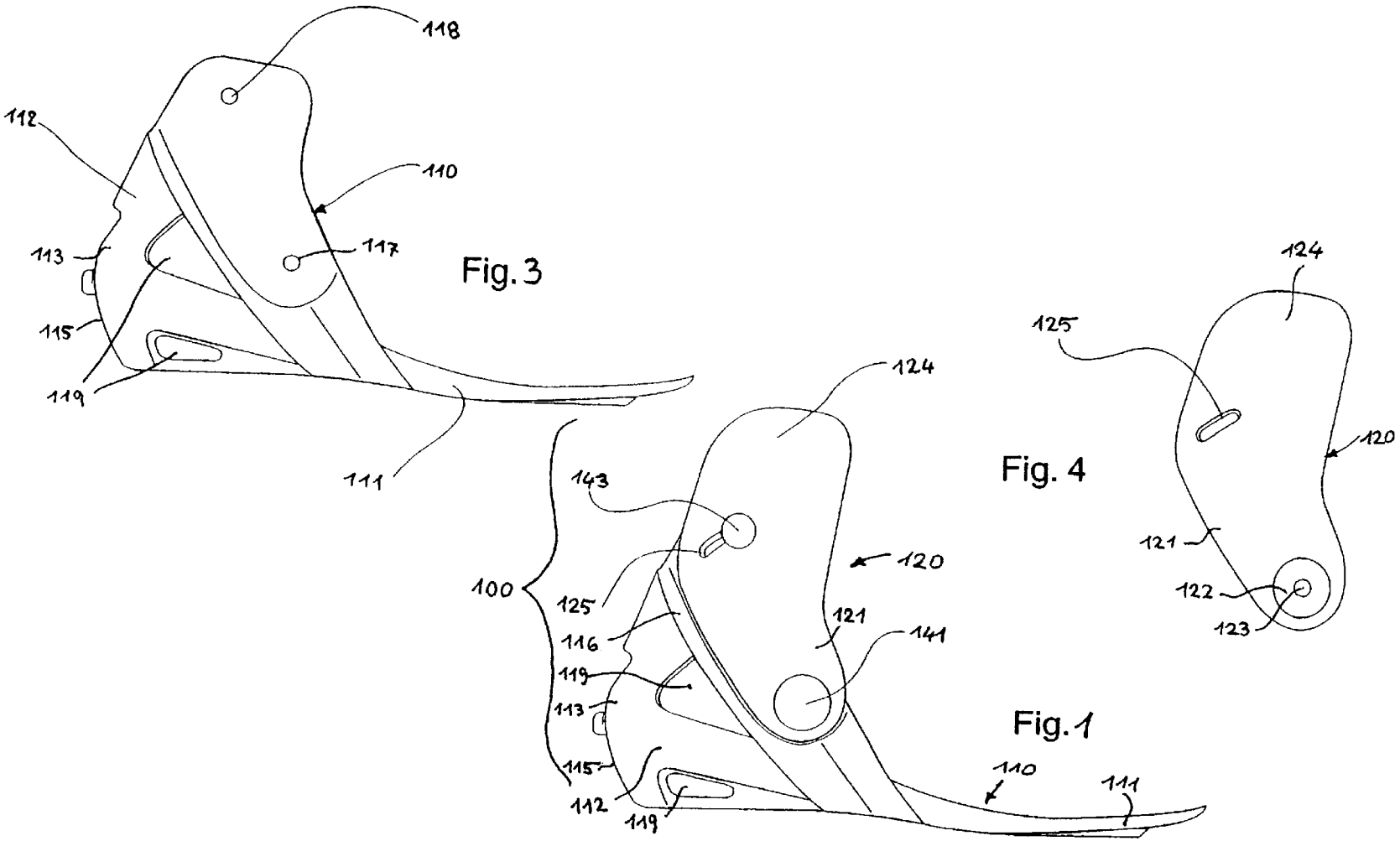
FIG. 1 is a side view of an articulated footwear reinforcement structure according to the present invention.
FIGS. 3 and 4 are side views of a first and respectively a second part belonging to the same articulated footwear reinforcement structure.

According to the invention, an articulated footwear reinforcement structure, as indicated generally at 100, comprises a first part 110, as well a second and a third part, which are generally indicated at 120 and 130, respectively (see FIGS. 4 and 5), in which each one of said parts is manufactured separately by injection moulding, or such other moulding technique as may be found appropriate, as individual moulded parts of polymeric materials having premium-grade mechanical properties. In order to realize the articulated structure 100, said second and said third part 120, 130 are separately joined to said first part 110 by means of a first and a second pair of pins 141, 142 and 143, 144. The axis X of the first pair of pins 141, 142 has a fixed arrangement with respect to all three parts joined by the relevant pins, and is substantially coinciding with the axis of the malleoli (i.e. of the ankle). The axes Y1, Y2 of the second pair of pins 143, 144 have on the contrary a fixed arrangement with respect to said first part 110 and a moving arrangement, albeit within certain limits as better explained further on, with respect to the other two parts 120, 130, wherein such an arrangement lies in all cases more in the rear with respect to and definitely above the axis X.

The first part 110 of the structure 100 (see FIG. 3) comprises a sole 111 and uprising portion 112 that, when seen from the top (see FIG. 5), is substantially U-shaped since it is adapted to envelop the heel with the inner side 113, the outer side 113 and the zone 115 thereof, which comes to lie in correspondence of the Achilles tendon owing to its being positioned between the sides 113, 114. On the exposed surface of the uprising portion 112, the first part 110 of the articulated reinforcement structure 100 is provided with a rib (of which only the one provided on the inner side 113 is shown, as generally indicated at 116, in the related FIGS. 3 and 5 of the accompany drawing) having a curved contour with forward and upward facing concavities, the function of which shall be more closely explained further on. On the same side 113 there are provided the round holes 117 for pin 141 along the axis X and 118 for pin 143 along the axis Y1. Similar holes (not shown) are provided on the outer side 114 for pin 142 along the same axis X and for pin 144 along the axis Y2, respectively. It should finally be noticed that the uprising portion 112 of the first part 110 of the articulated reinforcement structure 100 is provided in a substantially per se known manner with through-apertures 119 in view of enhancing aeration for the foot of the user.

Since the second part 120 and the third part 130 of the articulated reinforcement structure 100 are specular in their form and construction, only a description of said second part 120 is given herebelow with particular reference to FIG. 4, for obvious reasons of greater simplicity,.

The lower portion 121, in which there is provided a recess 122 intended for the head of the pin 141 and featuring a central round hole 123, which is adapted to be in due alignment with the afore mentioned hole 117 of the first part 110, forms a quite wide obtuse angle with the leg-piece portion 124, in which there is provided a curvilinear slot 125, which is adapted to be coupled with the afore mentioned hole 118 of the first part 110 for accommodating the pin 143. Owing to what has so been set forth above, the second part 120 and the third part 130 extend upwards to a greater height than said uprising portion 112 of the first part 110, i.e. well above the malleoli of the user as identifiable by the afore mentioned axis X of the pins 141, 142.

Figure 2:
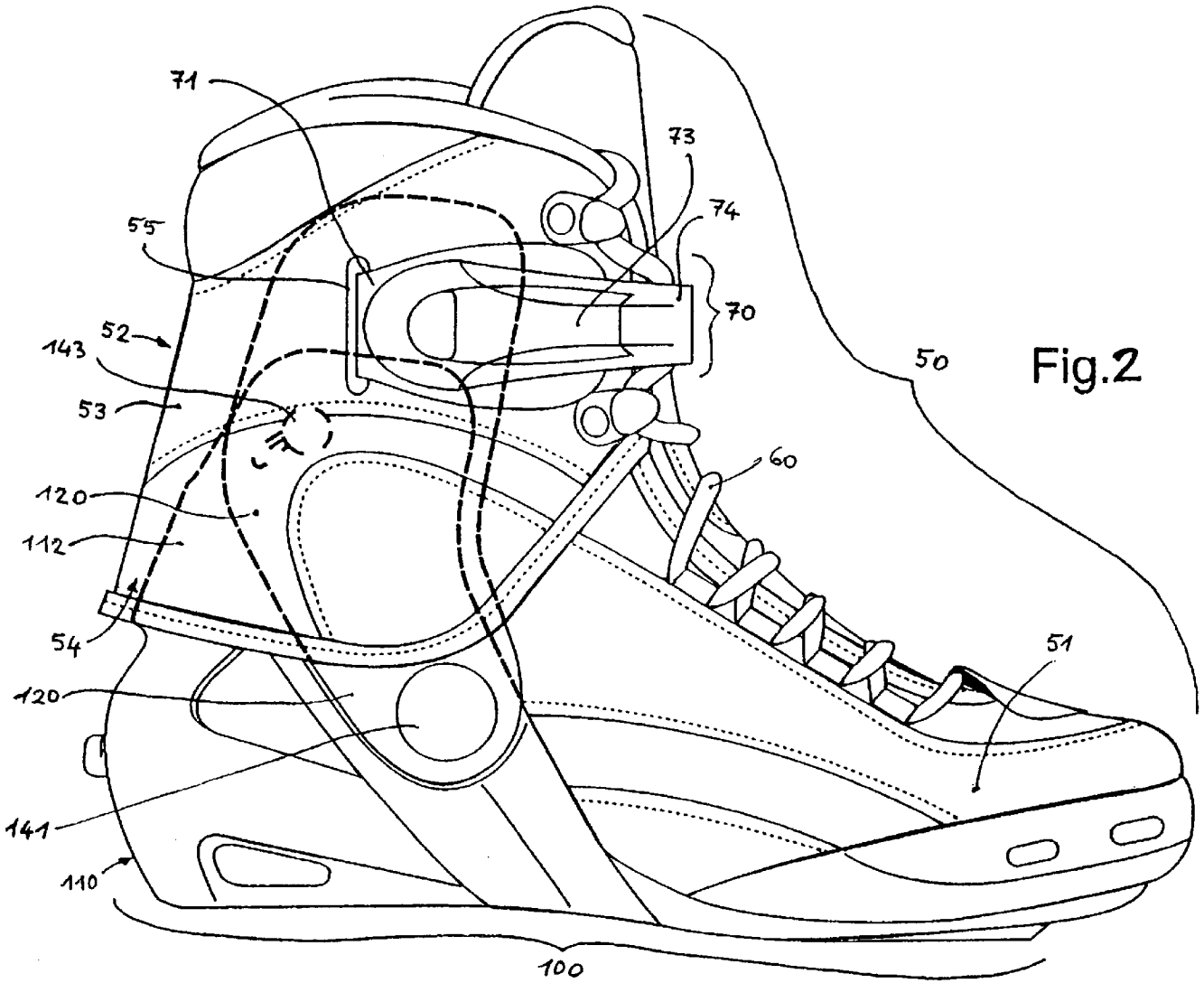
FIG. 2 is a side view of a boot for a roller skate with in-line rollers, comprising the articulated reinforcement structure of FIG. 1.

FIG. 2 illustrates, by way of example for this description, a footwear for roller skates with in-line rollers, in which said footwear, further to the articulated reinforcement structure 100 is constituted by a soft, flexible shoe 50 that is advantageously made as disclosed in a patent application filed jointly with the present one made by this same Applicant. To the purposes of the present invention, suffice it to say that the shoe 50 comprises a vamp 51 and a leg-piece 52 that has a border 53 folded downwards so as to form a kind of pocket 54 intended for accommodating the whole portion of the articulated structure 100 that lies above the first pair of pins 141, 142, i.e. above the axis X. The fastening of the footwear on the front thereof is ensured not only by a lace 60, but also by a fastening device, as generally indicated at 70, which first of all comprises a strap 71, which constitutes the fixed element thereof and is brought out through a pair of vertical slots (such as the one shown in FIG. 2 with reference numeral 55) after passing into the pocket 54 between the folded border 53 and the second part 120 of the articulated reinforcement structure 100, as well as into the pocket formed in the opposite side of the shoe 50 between the corresponding folded border and the third part 130 of the articulated reinforcement structure 100. At the protruding ends of the strap 71 there are attached the per se known elements of a lever system, which is also a part of the fastening arrangement 70 and comprises in turn a lever 73 and a serrated strap 74. In the finished footwear, the articulated reinforcement structure 100 is in this way prevented from separating from the shoe 50. When the fastening device is tightened, i.e. locked, the leg of the user is therefore shut in on the front side by the serrated strap 74 and, along the whole remaining portion of its circumference, by the strap 71.

Figure 5:
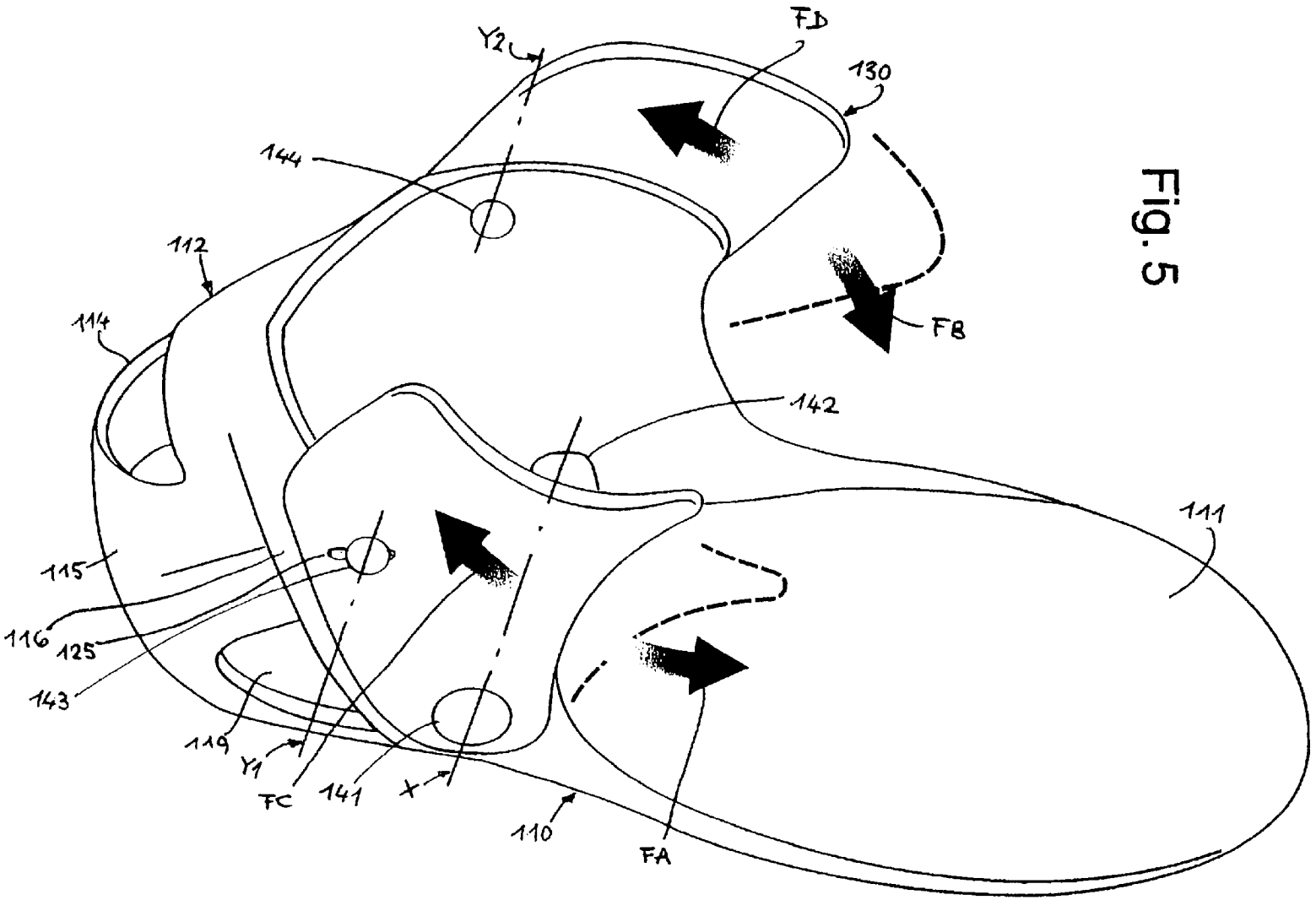
FIG. 5 is a three-dimensional top view of the same articulated footwear reinforcement structure.

The functionality ensured by the articulated reinforcement structure 100 according to the present invention can be best inferred from the illustration in FIG. 5. The second part 120 and the third part 130 of such a structure are capable of forward pivoting movements (see arrows FA, FB) and backward pivoting movements (see arrows FC, FD) with respect to the first part 110 thereof, in a manner that is fully independent of each other, about the fixed axis X of the first pair of pins 141, 142, whenever the leg is bent. These pivoting movements are favoured by the action exerted upon the same parts 120, 130 by said strap 71. The sliding motion of the second pair of pins 143, 144 within the curvilinear slots 125, 126 guides said rotations and, at the same time, contributes to the lateral support of the leg and the foot, in particular when the axes Y1, Y2 of the second pair of pins 143, 144 are coincident, so as to avoid sprains. The afore mentioned side ribs, such as the one indicated at 116, contribute, jointly with said slots 125 and 126, to restrict the amplitude, i.e. extent of these pivoting movements.

The inherent advantages of the present invention can be summarized as follows:

for the user, a far greater freedom of foot movement than in prior-art costructions, thanks to the possibility for the inner and outer sides of the footwear to be pivotally moved independently of each other;

again for the user, the preservation of the desired rigidity characteristics that ensure lateral support to both the foot and the lower portion of the leg;

for the footwear manufacturer, the possibility for uncomplicated, easy-made moulding tools to be used, in particular for said second and said third part of the articulated structure, and for the assembly process to be automated in respect not only of the various parts forming said articulated structure, but also in respect of the joining of the latter with the soft, flexible shoe.

Although the above description refers to a preferred embodiment of the present invention, it will be readily appreciated that those skilled in the art may be capable of developing the above described articulated structure, and therefore also the footwear provided therewith, in a number of different manners without departing from the scope of the present invention as defined by the appended claims.

What is claimed is:

1. An articulated footwear reinforcement, comprising:

a first part which comprises a sole and an uprising portion having a substantially U-shaped configuration adapted to envelop a heel of a user; and a second part and a third part being provided on opposite sides of a foot and being joined to opposing sides of the uprising portion of the first part by a first pair of pins defining a common fixed, first pivoting axis and a second pair of pins defining respective second pivoting axes, the second pivoting axes being staggered with respect to the fixed, first pivoting axis, the second and third parts being separate parts and the second pivoting axes having a fixed arrangement with respect to the first part and a limited moving arrangement with respect to the second and third parts respectively, each of the second and third parts being movable forwards and backwards with respect to the first part around the fixed, first pivoting axis, and the second and third parts being independently movable with respect to each other.

2. The articulated footwear reinforcement structure according to claim 1, wherein the structure is made of high-strength materials and wherein the first and second parts are separately manufactured as individual molded parts.

3. The articulated footwear reinforcement structure according to claim 1, wherein a height of the second and third parts exceeds a height of the uprising portion of the first part to which they are joined.

4. The articulated footwear reinforcement structure according to claim 3, wherein said second and third parts extend above a malleoli of a user.

5. The articulated footwear reinforcement structure according to claim 1, wherein the fixed, first pivoting axis is substantially coincident with an axis of a malleoli of a user.

6. The articulated footwear reinforcement structure according to claim 1, wherein the second and third parts each have a curvilinear slot and wherein one of the second pins is provided in each slot to connect the second and third parts to the first part, the second pins being accommodated in holes provided on the uprising portion of the first part.

7. The articulated footwear reinforcement structure according to claim 1, wherein on an exposed or outwardly facing surface of the uprising portion, at least one rib is provided, the at least one rib being for abutment against a side of at least one of the second and third parts to limit amplitude of backward movement relative to the first part.

8. The articulated footwear reinforcement structure according to claim 1, wherein at least one aperture is provided on at least said uprising portion of the first part to enhance aeration of a foot of a user.

9. The articulated footwear reinforcement structure according to claim 1, further comprising a shoe made of soft, flexible materials, having a vamp provide with laces and a leg-piece having a border folded downwards to form a pocket for accommodating a portion of the reinforcement structure that is above the fixed, first axis, the shoe further having fastening devices including a strap provided between the leg-piece and the portion of the reinforcement structure which is accommodated in the pocket.

10. The articulated footwear reinforcement structure according to claim 1, wherein the first, fixed axis is below the second pivoting axes.

11. The articulated footwear reinforcement structure according to claim 1, wherein the second and third parts are spaced from one another.

* * * * *

UNITED STATES PATENT AND TRADEMARK OFFICE

CERTIFICATE OF CORRECTION

PATENT NO. : 6,779,283 B2
DATED : August 24, 2004
INVENTOR(S) : Andrea Gabrielli It is certified that error appears in the above-identified patent and that said Letters Patent is hereby corrected as shown below:

Title page,
Item [73], Assignee, change "Tenica SpA" to -- Tecnica SpA --.

Signed and Sealed this

Sixth Day of September, 2005

JON W. DUDAS
*Director of the United States Patent and Trademark Office*